US006261426B1

(12) United States Patent
Uzoh et al.

(10) Patent No.: US 6,261,426 B1
(45) Date of Patent: Jul. 17, 2001

(54) METHOD AND APPARATUS FOR ENHANCING THE UNIFORMITY OF ELECTRODEPOSITION OR ELECTROETCHING

(75) Inventors: Cyprian E. Uzoh, Hopewell Junction, NY (US); Hariklia Deligianni, Edgewater, NJ (US); John O. Dukovic, Pleasantville, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/235,798

(22) Filed: Jan. 22, 1999

(51) Int. Cl.[7] ..... C25D 17/00
(52) U.S. Cl. ..... 204/224 R
(58) Field of Search ..... 204/224 R; 205/137

(56) References Cited

U.S. PATENT DOCUMENTS

| | | | | |
|---|---|---|---|---|
| 2,689,216 | | 9/1954 | Nevers et al. | 204/52 |
| 2,923,671 | | 2/1960 | Van Tilburg | 204/52 |
| 3,300,396 | | 1/1967 | Walker | 204/49 |
| 3,317,410 | | 5/1967 | Croll et al. | 204/23 |
| 3,558,464 | | 1/1971 | Danna | 204/219 |
| 3,652,442 | | 3/1972 | Powers et al. | 204/273 |
| 3,809,642 | | 5/1974 | Bond et al. | 204/275 |
| 3,962,047 | | 6/1976 | Wagner | 204/15 |
| 4,032,422 | | 6/1977 | Ross et al. | 204/224 R |
| 4,233,146 | | 11/1980 | Rothmayer et al. | 204/255 |
| 4,259,166 | * | 3/1981 | Whitehurst | 204/279 |
| 4,304,641 | | 12/1981 | Grandia et al. | 204/23 |
| 4,323,438 | | 4/1982 | Sesterhenn et al. | 204/128 |
| 4,466,864 | * | 8/1984 | Bacon et al. | 204/15 |
| 4,469,564 | | 9/1984 | Okinaka et al. | 204/15 |
| 4,469,566 | * | 9/1984 | Wray | 204/23 |
| 4,596,637 | | 6/1986 | Kozarkek et al. | 204/67 |
| 4,664,760 | | 5/1987 | Jarrett | 204/67 |
| 4,906,341 | | 3/1990 | Yamakawa et al. | 204/15 |
| 4,931,150 | | 6/1990 | Smith | 204/26 |
| 5,000,827 | | 3/1991 | Schuster et al. | 204/15 |

(List continued on next page.)

OTHER PUBLICATIONS

D. Edestein, "Advantages of Copper Interconnectors," Jun. 27–29, 1995, VMIC Conference—1995 ISMIC—104/95/0301.

D. Edestein, et al., "Full Copper Wiring in a Sub–0.25 um CMOSULSI Technology," IEEE IEDM, Washington, D.C. Dec. 7–10 (1997) pp. 301–307.

D. Edelstein, "Integration of Copper Interconnects," ECS 1996 month not available.

Equinox, Single Substrate Processing System, SEMITOOL. Advertising Brochure. EQU–025, Apr. 1994 p. 108.

Equinox, Introducing the First Fully End–to–End Plating Pricess, SEMITOOL Advertising Brochure, EQU:1002 6 pgs. Dec. 1994.

(List continued on next page.)

*Primary Examiner*—Kathryn Gorgos
*Assistant Examiner*—Erica Smith-Hicks
(74) *Attorney, Agent, or Firm*—Ratner & Prestia; Joseph P. Abate, Esq.

(57) ABSTRACT

An apparatus and method for an electrodeposition or electroetching system. A thin metal film is deposited or etched by electrical current through an electrolytic bath flowing toward and in contact with a target on which the film is disposed. Uniformity of deposition or etching is promoted, particularly at the edge of the target film, by baffle and shield members through which the bath passes as it flows toward the target. The baffle has a plurality of openings disposed to control the localized current flow across the cross section of the workpiece/wafer. Disposed near the edge of the target, the shield member shapes the potential field and the current line so that it is uniform.

12 Claims, 7 Drawing Sheets

U.S. PATENT DOCUMENTS

| | | | | |
|---|---|---|---|---|
| 5,023,044 | | 6/1991 | Negron | 376/213 |
| 5,222,310 | | 6/1993 | Thompson et al. | 34/202 |
| 5,228,966 | | 7/1993 | Murata | 204/224 R |
| 5,318,683 | | 6/1994 | Smith et al. | 204/252 |
| 5,377,708 | | 1/1995 | Bergman et al. | 134/105 |
| 5,391,285 | | 2/1995 | Lytle et al. | 205/123 |
| 5,429,733 | | 7/1995 | Ishida | 204/224 R |
| 5,431,823 | | 7/1995 | Gofer | 210/636 |
| 5,435,885 | | 7/1995 | Jones et al. | 216/92 W |
| 5,437,777 | | 8/1995 | Kishi | 204/224 R |
| 5,443,707 | | 8/1995 | Mori | 204/242 |
| 5,447,615 | | 9/1995 | Ishida | 204/224 R |
| 6,027,631 | * | 2/2000 | Broadbent | 205/137 |

OTHER PUBLICATIONS

D.C. Edelstein, IBM T. J. Watson Research Center, "Advantages of Copper Interconnects," Jun. 27–29, 1995 VMIC Conference 1995 ISMIC—104/95/0301, pp. 301–307.

D. Edelstein, et al., "Full Copper Wiring in a Sub–0.25 $\mu$m CMOS ULSI Technology," IEEE IEDM, Washington, D.C., (Dec. 1997).

D. Edelstein, IBM T. J. Watson Research Center, "Integration of Copper Interconnects," ECS (1996) no month available.

Equinox, Introducing the First Fully End–to–End Plating Process. SEMITOOL Advertising Brochure, EQU: 1002 6 pgs. Dec. 1994.

* cited by examiner

METHOD AND APPARATUS FOR ENHANCING THE UNIFORMITY OF ELECTRODEPOSITION OR ELECTROETCHING

TECHNICAL FIELD

The present invention relates generally to the manufacture of metal and metal alloy films on electrical components and, more particularly, to apparatus and methods for uniformly depositing or etching thin metal (or alloy) layers on a semiconductor wafer substrate.

BACKGROUND OF THE INVENTION

Electroplating and electroetching are manufacturing techniques used in the fabrication of metal and metal alloy films. Both of these techniques involve the passage of current through an electrolytic solution between two electrodes, one of which is the target to be plated or etched. The current causes an electrochemical reaction on the surface of the target electrode. This reaction results in deposition on or etching of the surface layer of the electrode. In the plating or etching of thin metal films disposed on a non-conductive substrate, the current tends not to be uniformly distributed over the surface of the target. This non-uniformity is attributed, at least in part, to the so called "terminal effect", i.e., the influence on plating distributions of ohmic potential drop within the thin metal film that acts as an electrode. This effect is exacerbated with increased wafer sizes, decreased seed layer (metallized film) thickness and decreased final deposited layer thickness (often less that 1 um (micron) in newer designs.

Control of the uniformity of the deposited or etched layer on the target electrode surface (sometimes referred to as the substrate) is particularly important in the fabrication of micro-electronic components. Uniformity is an important consideration when electroplating or electroetching is used to make thin-film electronic components, including resistors, capacitors, conductors, and magnetic devices such as propagation and switch elements. U.S. Pat. No. 3,652,442 issued to Powers et al. and U.S. Pat. No. 4,304,641 issued to Grandia et al. disclose electrolytic processes and apparatus in which alloy and dimensional uniformity are important factors.

In a cup plater, which is often used in the manufacture of small thin-film electronic components, plating uniformity is controlled, to some extent, by system geometry, bath composition, bath flow control, and operating conditions. In one such cup plater (known as "EQUINOX", available from Semitool, Inc.) a baffle, disposed between the target electrode and the counter electrode to affect ion distribution, comprises a plate with a plurality of uniform, and uniformly distributed holes. Nevertheless, a condition known as "edge effect" remains a problem. Edge effect manifests itself as the non-uniform thickness that occurs on the edges of a target electrode surface as it is etched or plated.

An object of the present invention is to provide improved electroetching and electroplating apparatus and methods to achieve relatively uniform distribution over the entire surface of an electroetched or electroplated thin metal film, and particularly at the outer edge of the metal film.

SUMMARY OF THE INVENTION

To achieve this and other objects, and in view of its purposes, the present invention provides an apparatus and method for an electrodeposition or electroetching system. In accordance with this invention, a thin metal film is deposited or etched by electrical current through an electrolytic bath flowing toward and in contact with a metallized target (or "wafer") on which the etched or deposited film is disposed. Uniformity of deposition or etching is promoted, particularly at the edge of the target film, by baffle and shield members through which the bath passes as it flows toward the target. In general, the baffle/shield combination "shapes" the potential field lines next to the target electrode i.e. wafer. The baffle has a plurality of openings disposed to control localized bath flow across the cross section of the bath path. Disposed near the edge of the target, a shield member prevents direct flow of bath toward the edge of the target. Preferably, the baffle causes a proportionately greater rate of current flow toward the center of the target, as compared to that toward the edge of the target, and the shield deflects the current so that the current lines are straight toward the edge of the target.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawings. It is emphasized that, according to common practice, the various features of the drawings are not to scale. On the contrary, the dimensions of the various features are arbitrarily expanded or reduced for clarity. Included in the drawings are the following figures.

DETAILED DESCRIPTION OF THE INVENTION

In manufacturing electronic components or other devices with thin, conductive (commonly metal or metal alloy) films, electroetching or electroplating of the film is accomplished by making electrical contact with the film at its edge. Although highly conductive metal may be used for such a film, the thin structure of the film nevertheless gives the film a high ohmic resistance. Such resistance directs, in turn, a disproportionate amount of the electroetching or electroplating current density toward the edge of the film. In general, the function of the present invention is to produce more uniform electroetched or electroplated films in electroetching and electroplating processes by modifying the localized concentration of ions in the electrolytic bath in contact with different parts of the target film. As exemplified by the embodiment of the present invention shown in FIG. 1, this function is achieved by modifying the current flow or by shaping the potential field between anode and cathode (the workpiece or wafer) and the localized current flow rate as it approaches the electroetching or electroplating target.

Figure 1:
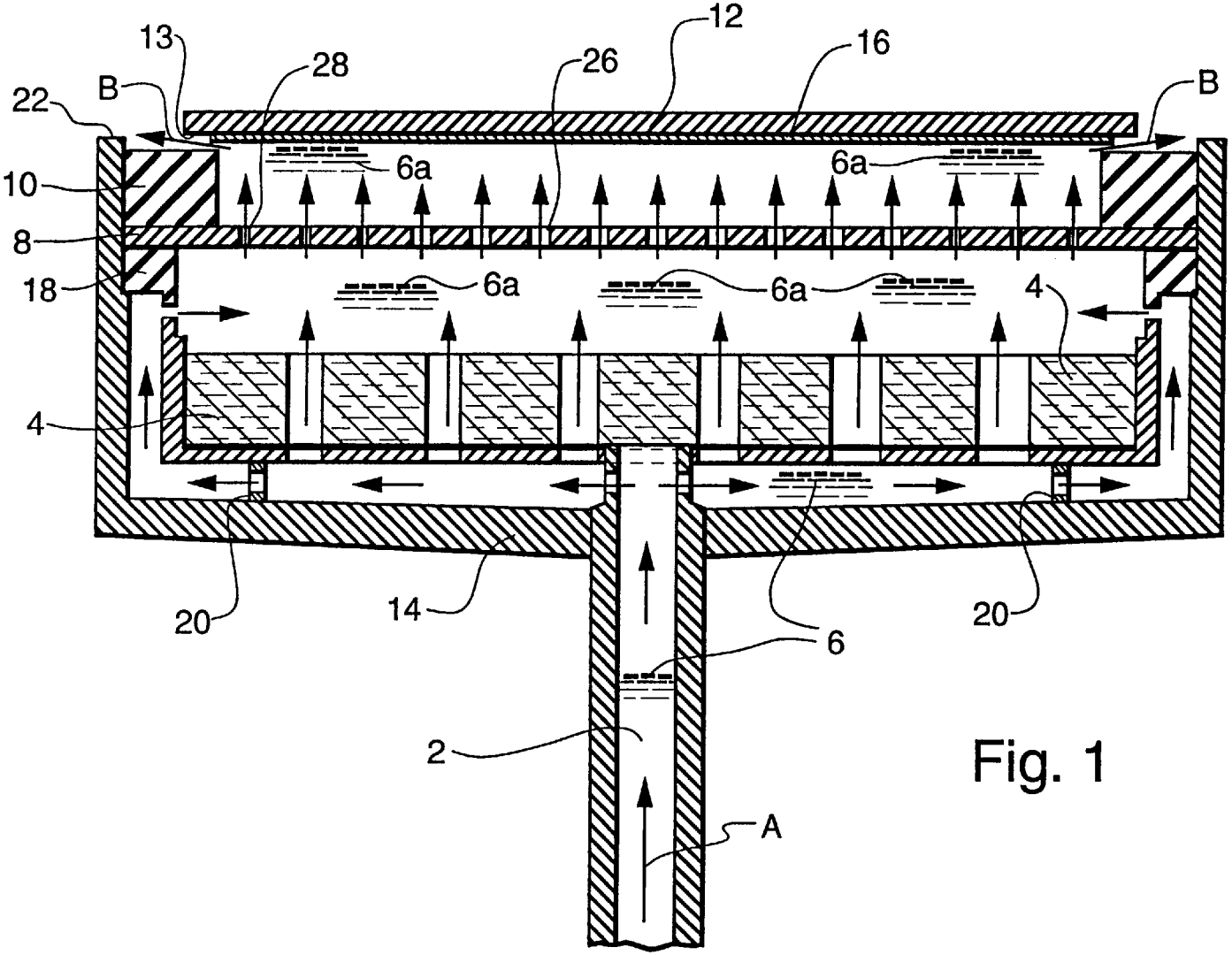
FIG. 1 is a schematic cross-sectional view of an electrolytic cell in which a baffle/shield member of the present invention is used.

Referring now to the drawings, wherein like reference numerals refer to like elements throughout, FIG. 1 shows a cross-sectional view of one embodiment of an apparatus, commonly referred to as a cup plater, exemplary of the present invention. In general, cup plating apparatus, typically cylindrical in plan view, are well known. See, for example, U.S. Pat. No. 5,000,827 issued to Shuster et al. In such apparatus, electrical contact with a downwardly facing thin etching or plating target (typically a thin metal film 16 on a non-conductive substrate 12, as seen in FIG. 1, is made at the edge of the target. Although not shown in FIG. 1, a plurality of clips attached around the circumferential edge of the target is a common method to make electrical connection with the conductive layer of the target.

The apparatus shown in FIG. 1 includes a cylindrical container or cup 14. Cup 14 has an inlet 2 through which electrolyte 6 enters cup 14 and flows (in the direction of arrows "A") upwardly toward substrate 12, constantly replenishing electrolyte bath 6*a*. Substrate 12 (sometimes referred to as a "wafer") is typically circular, planar, and non-conductive. A downwardly facing thin metal film 16, of slightly smaller circular dimension than substrate 12, is provided on substrate 12. Film 16 may be electroetched, or may serve as a seed layer for electroplating, in accordance with the present invention. Film 16 is located at or just below cup lip 22, and is in contact with the top surface of bath 6*a*.

Electrolyte 6 flows over the top of the cup lip 22 (in the direction of arrows "B") and is collected and recycled back to a pumping mechanism, not shown, from which electrolytic bath 6*a* is replenished through inlet 2 as electrolyte 6 enters cup 14. Cup 14 also contains a counterelectrode 4 upheld by a support member 20. Two configurations of counterelectrode usable in the present invention are those disclosed in co-pending applications, of common assignment herewith, presently pending in the U.S. Patent Office, U.S. patent applications Ser. No. 09/969,196; filed Nov. 13, 1997 and Ser. No. 09/192,431; filed Nov. 16, 1998. Those applications are incorporated hereby by reference. Counterelectrode 4 is in electrical connection with a voltage source, the opposing pole of which is in contact with thin metal film 16.

Figure 2:
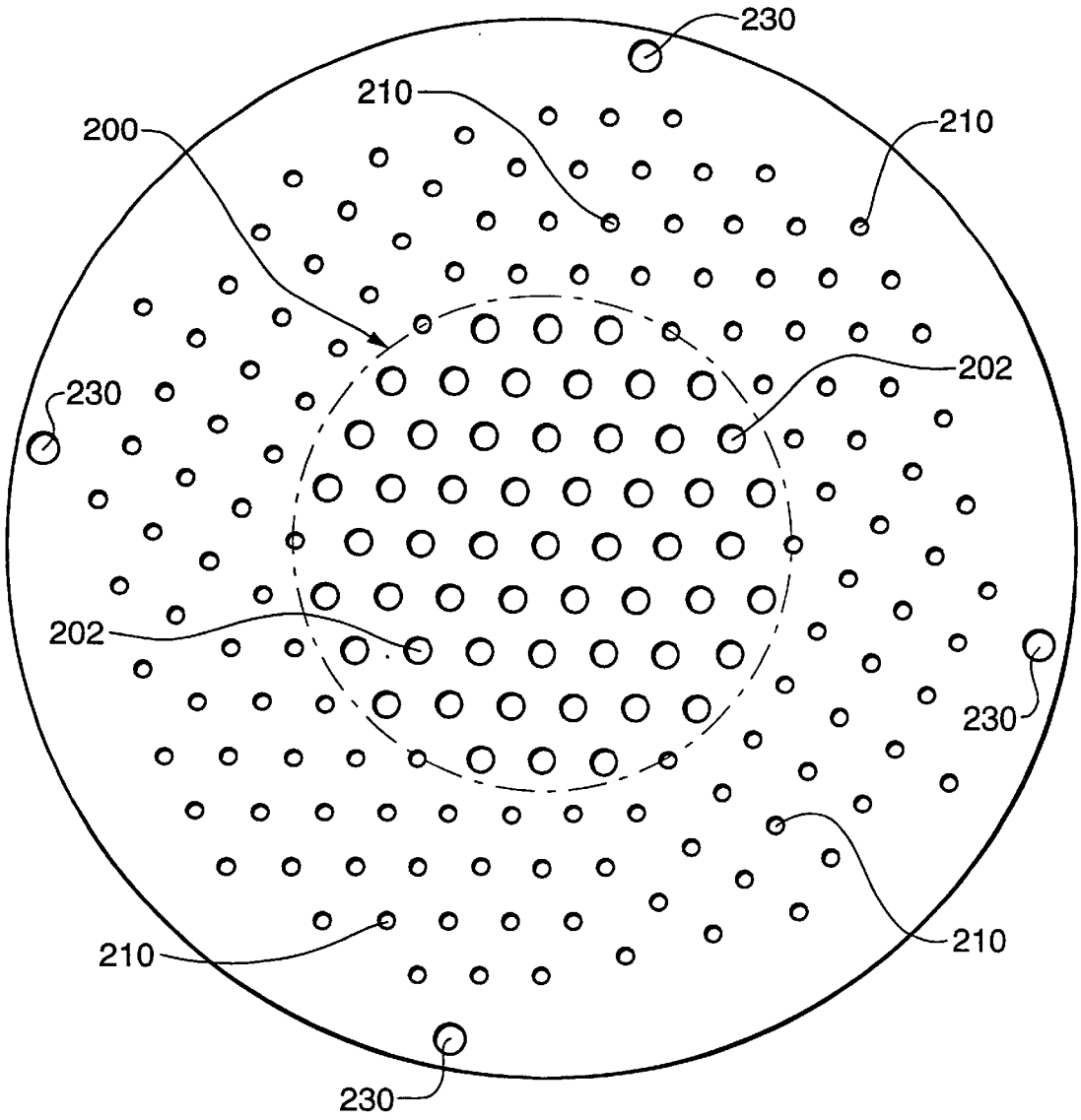
FIGS. 2, 3, 4, and 5 are top views of different baffle plates, with openings of various sizes, which may be used in the apparatus shown in FIG. 1.
Figure 3:
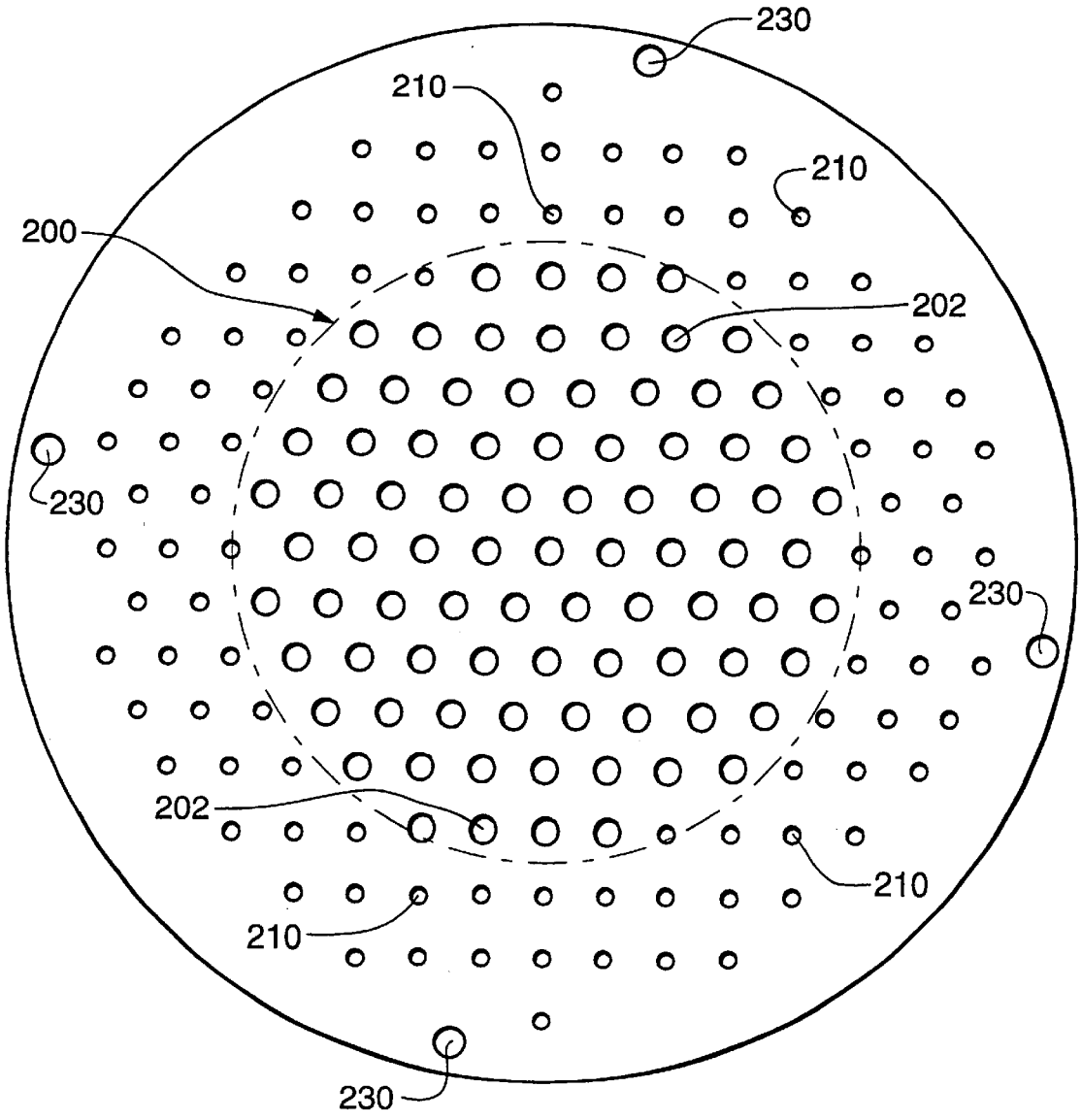
Figure 4:
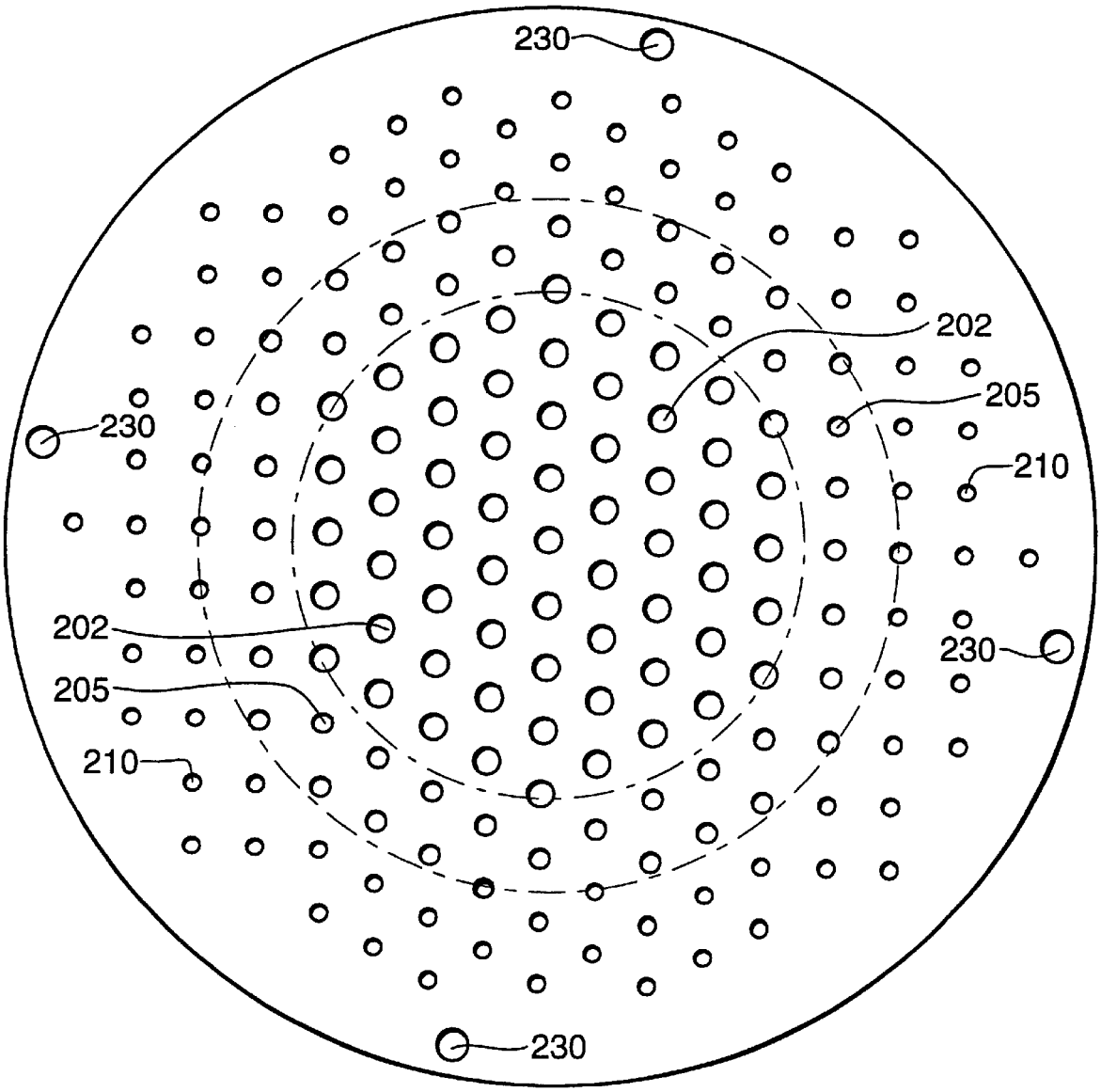

Interposed for bath flow control between counterelectrode 4 and target substrate 12 are baffle 8, supported by mounting bracket 18, and shield 10, supported by baffle 8. Both baffle 8 and shield 10 are comprised of a non-conductive material such as Teflon, PVDF or polyvinylchloride. Baffle 8 includes relatively larger flow openings 26 and relatively smaller flow openings 28. Larger openings 26 are located toward the center of the cross section of bath flow and smaller openings 28 near the edge of the cross section. This arrangement of openings 26, 28 causes a disproportionate amount of current flow toward the center of target substrate 12. Details of several embodiments of baffle 8 are illustrated in FIGS. 2, 3, 4, and and are discussed below. All of these embodiments of baffle 8 described herein include non-uniform hole sizes and distribution to effect the ion flow distributions as described above. When combined with shield 10, however, a baffle with a uniform pattern may also be used, in accordance with the present invention.

Shield 10 is typically an annular ring and can be a drop-in member which rests on baffle 8, and with which the various forms of baffles may be interchanged. Further, shield 10 is disposed between baffle 8 and substrate 12, interposed at that part of the flow path of bath 6*a* just below the face of thin metal film 16 and the edge area 13 of substrate 12 not covered by film 16. Thus, shield 10 is positioned to prevent direct flow of bath 6*a* toward the edge of thin metal film 16.

The disproportionate amount of localized bath flow rate approaching substrate 12 and thin metal film 12 is controlled, at least in part, by the location and size of flow openings 26, 28 in baffle 8. Preferably, a mechanism also is provided to rotate substrate 12 during the electroetching or electroplating process to further normalize the uniformity of the etched or plated film and particularly to eliminate any tendency toward radially displaced non-uniformity. Several embodiments of baffle 8 having openings 26, 28 are shown in FIGS. 2, 3, 4, and 5.

Embodiment A of baffle 8, shown in FIG. 2, includes a plurality of openings 202 in area 200, all disposed in a hexagonal pattern within a radius of about 50 mm from the center of the baffle 8, and a plurality of openings 210 located outside of area 200. Openings 202 each have a diameter of about 4.8 mm; openings 210 each have a diameter of about 3.2 mm. Larger holes 230, located near the edge of baffle 8, are used for purposes of mounting and should not be confused with flow openings 202, 210.

Embodiment B, shown in FIG. 3, is similar to Embodiment A, but the plurality of larger openings 202 in Embodiment B includes 85 openings, as compared to 55 in Embodiment A. The plurality of smaller openings 210 in Embodiment B includes 102 openings, as compared to 152 in Embodiment A. Openings 202 in Embodiment B are also located within a slightly larger radius, namely about 57 mm, than in Embodiment A.

Embodiment C, shown in FIG. 4, includes larger openings 202 of about 4.8 mm in diameter within an area defined by a radius of about 50 mm, intermediate sized openings 205 about 4.0 mm in diameter between the radii of about 50 mm and 57 mm, and smaller openings 210 about 3.2 mm in diameter outside of the 57 mm radius.

Figure 5:
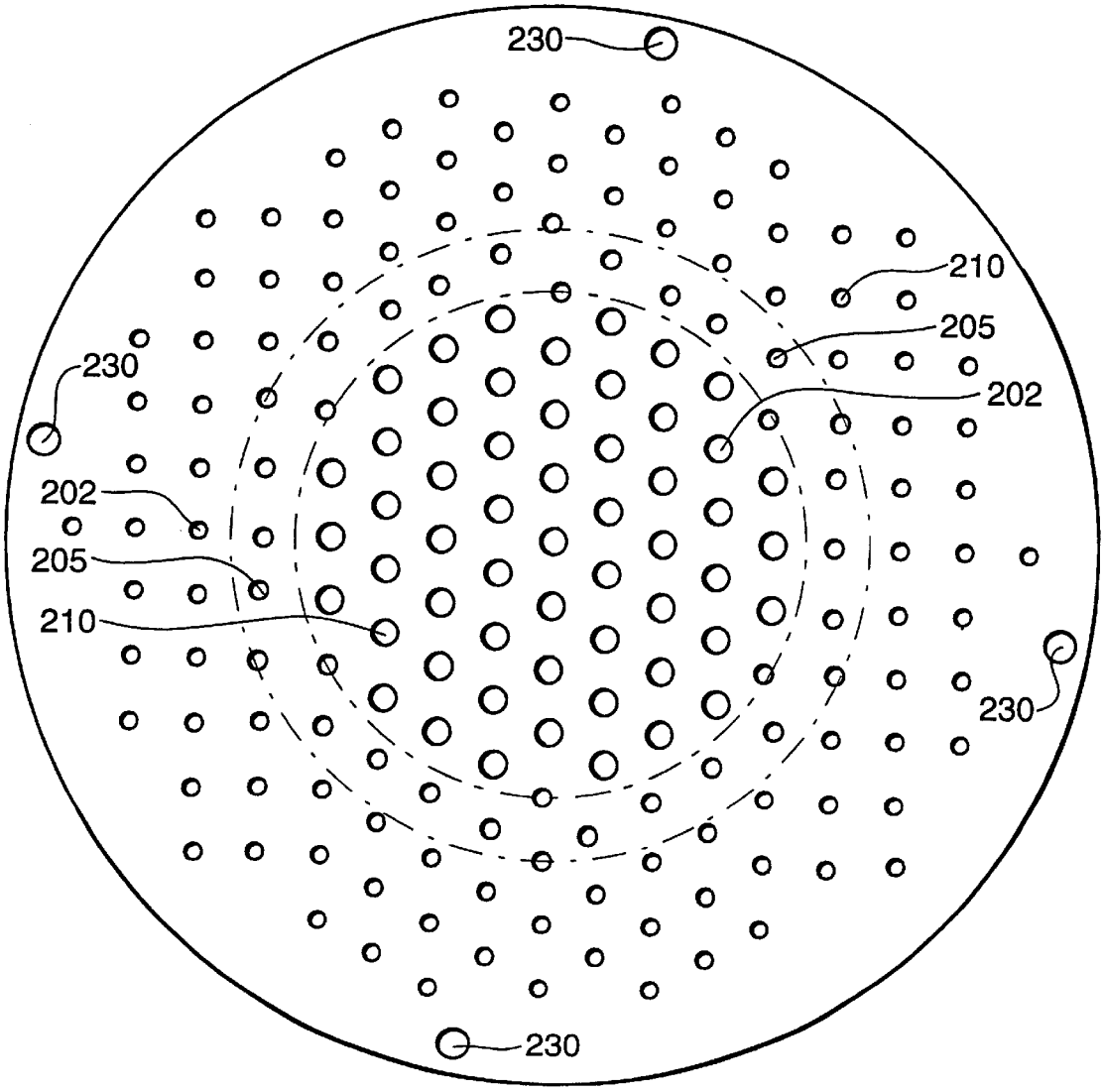

Embodiment D, shown in FIG. 5, is similar to Embodiment C, shown in FIG. 4, except that Embodiment D includes fewer openings in each group of openings. More specifically, the table provided below lists the number of opening in each group of openings for Embodiments C and D. The sizes of the larger, intermediate, and smaller openings are the same for each embodiment.

| | Embodiment C | Embodiment D |
|---|---|---|
| Number of Openings in Plurality of Openings 202 | 61 | 55 |
| Number of Openings in Plurality of Openings 205 | 46 | 34 |
| Number of Openings in Plurality of Openings 210 | 80 | 98 |

All of the baffle embodiments A-D, described above, have an outside diameter of 216mm, for use in a cup plater with a nominal inside diameter of the same dimension. The inside diameter of shield 10 is about 192 mm and the diameters of the substrate 12 and thin metal film 16 are about 200 and 192 mm, respectively. Thus, shield 10 is disposed below an annular unmetallized (d) edge 13 of the substrate 12, which is about 4 mm wide.

In an exemplary embodiment, metal film 16 is pure copper with a thickness of about 300 Angstroms. This thickness may vary within a range between 100 to 4,000, preferably between 100 to 2,500 Angstroms, and most preferably 100–600 Å. Generally, with other dimensions as described above, the spacing between shield 10 and substrate 12 is about 2 mm and the spacing between baffle 8 and substrate 12 (corresponding generally to the height of shield 10 plus the distance between shield 10 and substrate 12) is about 20 mm. A shorter distance between baffle 8 and substrate 12 is not recommended because an imprint of the baffle openings on the substrate may occur but a larger distance may be used (up to about 60 mm.) provided that the shield thickness is adjusted, in combination with the space between shield 10 and substrate 12, to fill the gap between the baffle plate and the substrate.

Although the diameter of the cup 14 and the related dimensions of the substrate 12, thin metal film 16, baffle 8, and shield 10 may be substantially less than or more than this those in this example, the practical range for these diametric dimensions is thought to be about 150 mm to 400 mm. In any event, the width of the unmetallized wafer edge area 13 of the substrate 12, is generally 2 to 8 mm. This also defines the width of the wafer/metal film edge 13 to be blocked by the shield 10. The inner diameters of shield 10 may therefore vary, with a 200 mm substrate, from 184 to 196 mm. It is not necessary that these dimensions correspond exactly. Generally, there should be a slight overlap of shield 10 with the outer edge of film 16.

With dimensions as generally indicated for the exemplary embodiment, the mechanism used to rotate substrate 12 provides a speed of rotation of 60 rpm in the exemplary embodiment. The pump for circulating bath 6*a* provides, in the exemplary embodiment, a gross bath flow rate of about 2 gallons per minute. Neither of these variables is thought to be critical.

With other nominal plating conditions, well known in the art, a highly uniform copper plating on the order of 0.6 microns thick can be achieved.

The present invention can be used to electroetch or electroplate a wide variety of metals and metal alloys.

Among these are metals deposited or etched from an electrolytic bath containing one or more metallic ions selected from the group consisting of gold, silver, palladium, lead, copper, platinum, tin, nickel, indium, and lead-tin alloys.

Figure 7:
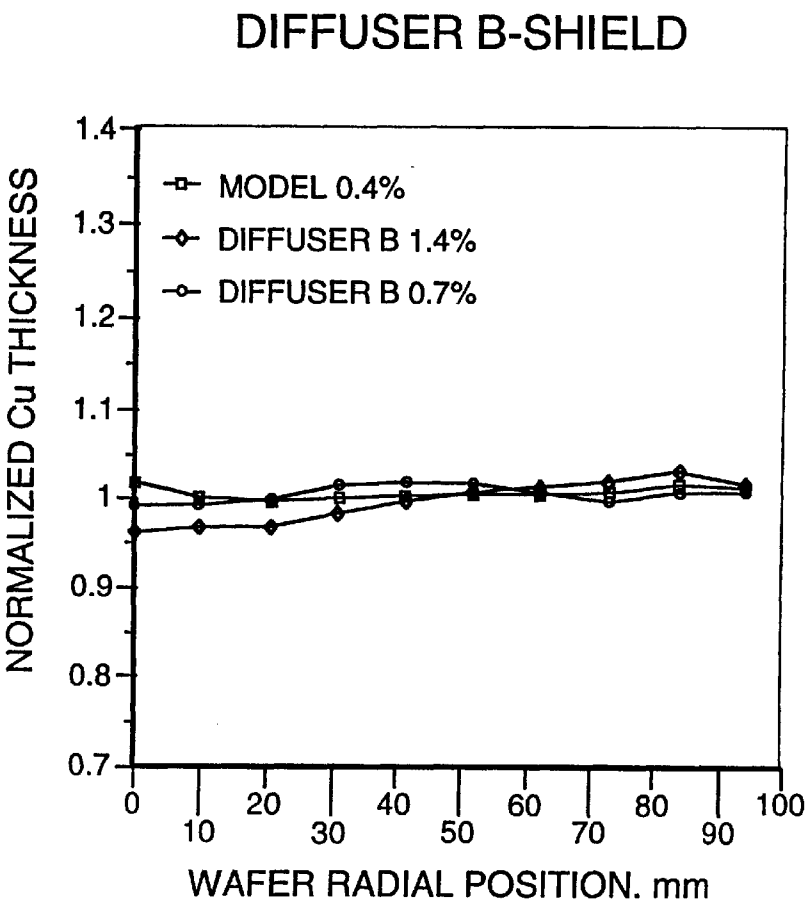
FIGS. 7 and 8 are plots of thickness distribution along the radii of a substrate plated in accordance with the present invention, with various non-uniform hole baffles (or diffusers).
Figure 8:
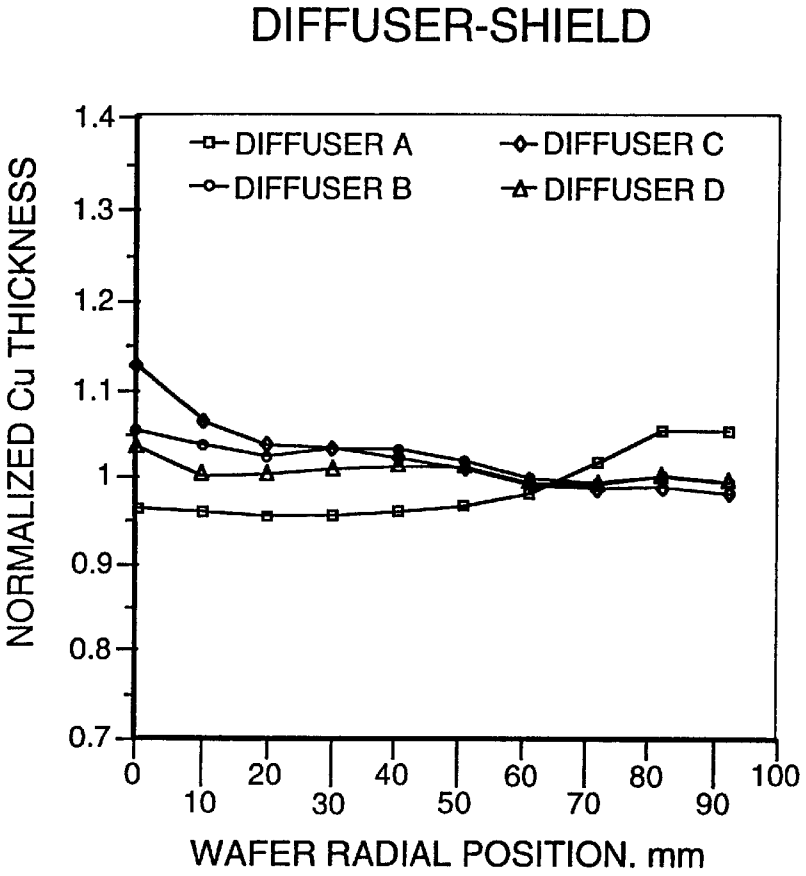

The embodiments of this invention described above has been used in various electroplating experiments, with a copper plating bath, the results of which are shown in FIGS. 7 and 8. For comparison, the results of experiments with a uniform hold baffle 8 with shield 10 and with various configurations of non-uniform hole baffles 8, but without shield 10, are shown in FIGS. 7 and 9, respectively.

Figure 6:
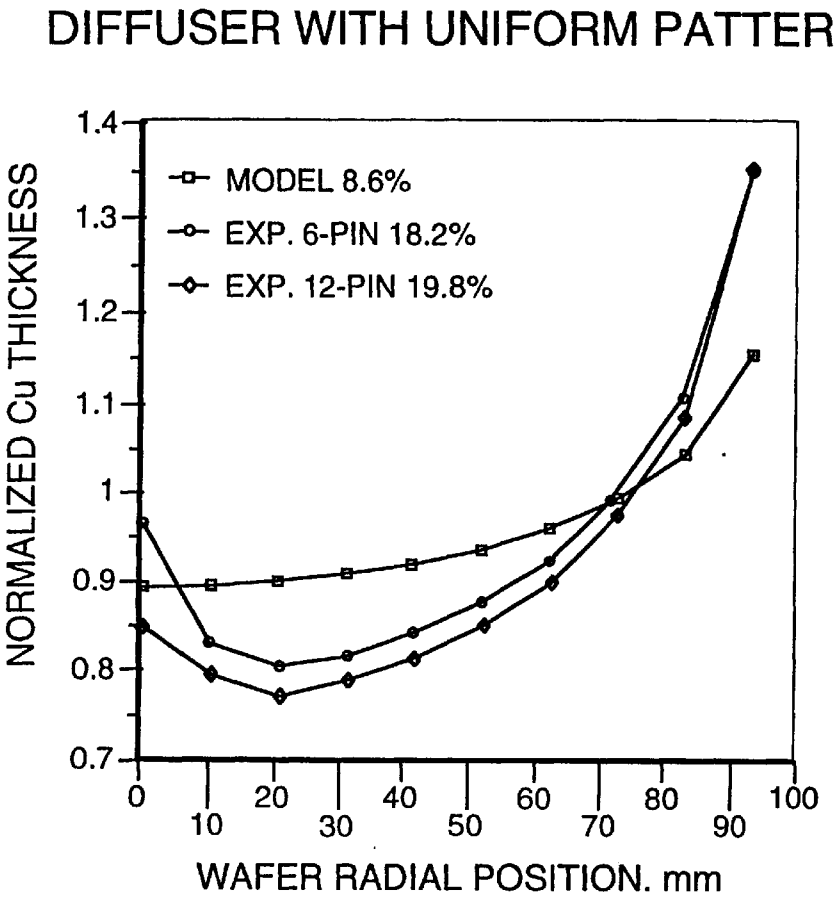
FIGS. 6 and 9 are plots of thickness distributions along the radii of a plated substrate achieved using a uniform hole baffle (FIG. 6) and with no shield (FIG. 9)

More specifically, FIG. 6 is a graph illustrating the variation in copper thickness on planar substrate 12, with plating parameters and system geometry as otherwise described for the exemplary embodiment described above. FIG. 6 compares the normalized copper thickness resulting from the plating process on the circular substrate at different radial positions. The important feature of this experiment is that, instead of baffle 8 with non-uniform openings to proportionalize localized bath flow velocity toward the center of substrate 12, a baffle (also referred to as a diffuser) with a uniform pattern was used during the plating process. The openings in this baffle member were also of uniform size, namely, having a diameter of about 4.7 mm. As shown in FIG. 6, the results reflected a thickness variation at different radial positions which varied from 8.6% to 19.8%, for a predictive model and for two test set-ups, in which the primary variable was the number of pin connectors to the metallized film.

FIG. 7 is a graph comparing the normalized copper thickness along the surface of the substrate using the baffle 8 of Embodiment B (shown in FIG. 3) and a shield 10. The experimental conditions used to generate FIG. 7 were otherwise the same as those used to generate FIG. 6. As illustrated in FIG. 7, the one sigma thickness variation is 0.7% and 1.4%, respectively. FIG. 8 illustrates similar results using a diffuser or baffle 8 according to Embodiments A, B, C, and D.

Figure 9:
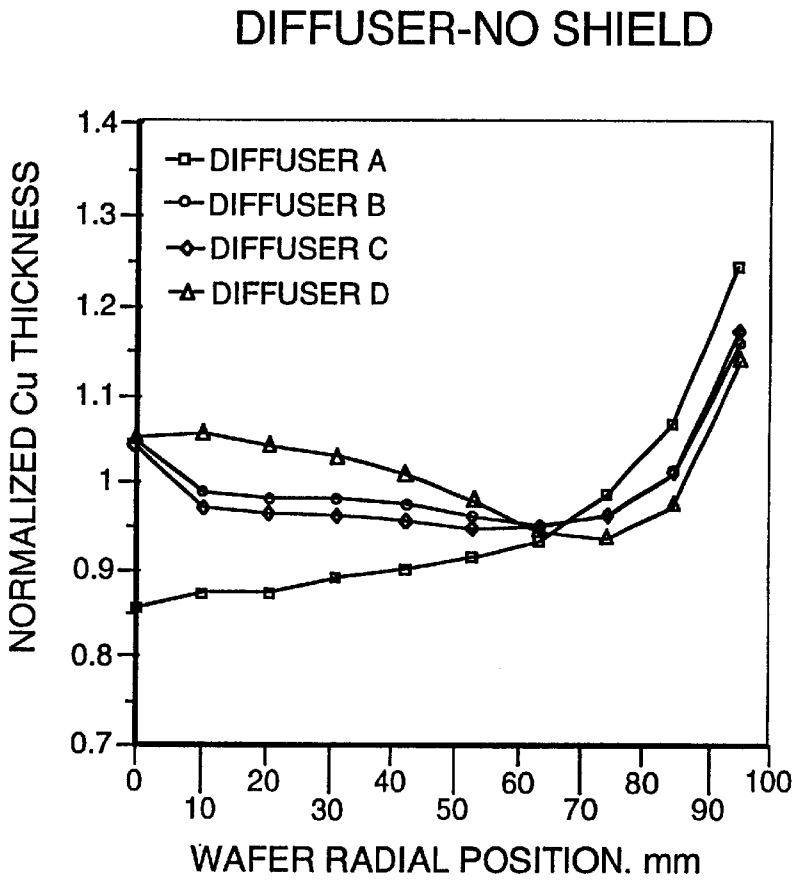

FIG. 9 is another graph comparing the normalized copper thickness to substrate (or wafer) radial position. For the experiments illustrated in FIG. 9, Embodiments A, B, C, and D of baffle 8 (represented in FIGS. 2, 3, 4, and 5, respectively) were again used but shield 10 was removed. The graph illustrates that the edge effect was apparent in all of the experiments regardless of which baffle embodiment was used. More specifically, significant thickness variation was observed, apparently due to the absence of shield 10.

In general, a uniform hole baffle 8 gives acceptable thickness variation when the initial metal film thickness is 1000 Å–1500 Å or more and the plated thickness is on the order of 1 $\mu$m or more.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed:

1. An apparatus for uniformly electroplating or electroetching a thin metal film, said film being disposed on a non-conductive planar substrate and covering one surface of said substrate except for a narrow unmetallized portion of said substrate at the edge thereof, the apparatus comprising:

an open top container containing an electrolytic bath;

means for causing said bath to flow in a flow path upwardly in said container and to overflow at the open top of said container, means for supporting said substrate with the metal film surface thereof facing downwardly and in contact with the top of said bath, a flow-modifying baffle interposed across the flow path of said bath, disposed below said film, and spaced at a preselected distance from said film, said baffle having a plurality of flow openings, said openings distributed radially from the center of said flowpath, a shield disposed above said baffle and spaced a preselected distance from said film, said shield being shaped and positioned to prevent direct flow of said bath toward said unmetallized edge of said substrate and to permit direct flow of said bath toward the remainder of said substrate, including said metal film, the outer diameters of said baffle and said shield corresponding to the inner diameter of said container, said apparatus further including means for imposing an effective electroetching or electroplating voltage between said film and a counterelectrode disposed below said baffle.

2. The apparatus of claim 1, wherein the electrolyte in said electrolytic bath is a metallic ion selected from the group consisting of ions of gold, silver, lead, copper, platinum, palladium, tin, nickel, and alloys thereof.

3. The apparatus of claim 2, wherein said film, prior to electroplating or electroetching, is 100–3,500 Angstroms thick.

4. The apparatus of claim 1, further including means for rotating said planar substrate during said electroplating or electroetching process.

5. The apparatus of claim 1, wherein the inner diameter (a) of said container is 150 to 400 mm, the outer diameter of said substrate is less than the outer diameter of said container, the outer diameter of said film (b) and the inner diameter of said shield are generally 4–16 mm less than the outer diameter of said substrate, and the distances (c,d) between said film and said shield (c) and said baffle (d) are 1.0 to 4 mm and 20 to 60 mm, respectively.

6. The apparatus of claim 5, wherein (a) is 150 to 250 mm, and (b) is 2–8 mm.

7. The apparatus of claim 5, wherein (a) is about 216 mm, said substrate outer diameter is about 200 mm, distances (c) and (d) are about 2 mm and 20 mm respectively and (b) is about 4 mm.

8. The apparatus of claim 1, wherein the openings in said baffle are 3 to 5 mm in diameter and are relatively uniformly distributed within the inner diameter of said shield.

9. The apparatus of claim 1, wherein the openings in said baffle vary from about 3 mm in diameter near the center of said baffle to about 5 mm at a radial distance from said center slightly less than the inner radius of said shield.

10. The apparatus of claim 7, wherein the openings in said baffle vary from about 3 mm in diameter near the center of said baffle to about 5 mm at a radial distance from said center slightly less than the inner radius of said shield.

11. The apparatus of claim 1, wherein the baffle includes a plurality of circumferentially and radially dispersed openings wherein the area of said openings toward the edge of said baffle are less than the area of said openings near the center of said baffle.

12. The apparatus of claim 11, further including means for rotating said baffle.

* * * * *